United States Patent [19]

Oberle

[11] 4,080,790

[45] Mar. 28, 1978

[54] SAFETY SYSTEM FOR A STEAM TURBINE INSTALLATION

[75] Inventor: Arthur Oberle, Ennetbaden, Switzerland

[73] Assignee: BBC Brown Boveri & Company Limited, Baden, Switzerland

[21] Appl. No.: 728,287

[22] Filed: Sep. 30, 1976

[30] Foreign Application Priority Data

Aug. 2, 1976 Switzerland ..... 13346/76

[51] Int. Cl.[2] ..... F01K 9/00

[52] U.S. Cl. ..... 60/661; 60/646; 60/686; 60/690; 415/49

[58] Field of Search ..... 60/646, 657, 660, 661, 60/686, 690, 692; 415/49, 50

[56] References Cited

U.S. PATENT DOCUMENTS

| | | | |
|---|---|---|---|
| 3,683,620 | 8/1972 | Kalverboer | 60/657 |
| 3,750,395 | 8/1973 | Tapper et al. | 60/686 |

*Primary Examiner*—Allen M. Ostrager
*Assistant Examiner*—Stephen F. Husar
*Attorney, Agent, or Firm*—Pierce, Scheffler & Parker

[57] ABSTRACT

A steam turbine installation includes a safety system located in the steam flow path having a stop valve located in the steam flow path upstream of the turbine and a vacuum break valve located in the stream flow path downstream of the turbine, and a combined regulating and safety device connected to the turbine produces signals for controlling these valves. In addition, a signal from a steam flow monitor located downstream of the stop valve is supplied to a logic system, this signal having a value which normally corresponds to the setting of the stop valve. In the event of a disparity the logic system functions to trip the regulating and safety device which results in a closure of the stop valve and a partial opening of the vacuum break valve. Upon detection of a further mass flow by the steam flow monitor after the partial vacuum condition has been reached the logic system functions to move the vacuum break valve to full open position and activate a water injection valve that sprays cooling water on the last rows of the low pressure blading of the turbine.

5 Claims, 1 Drawing Figure

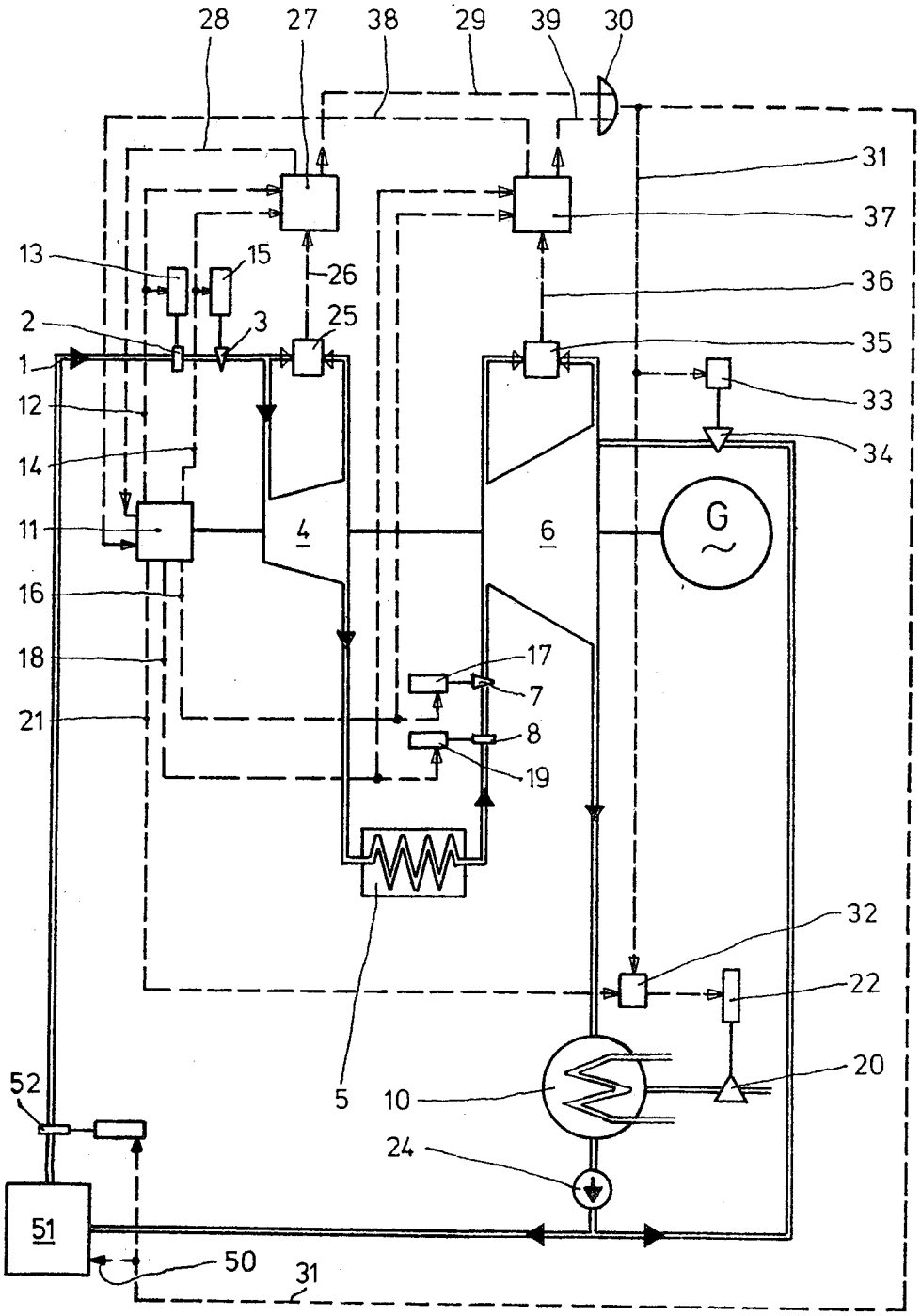
28
27
38
29
39
30
31
37
13
15
26
36
2
3
25
35
1
33
12
34
14
11
4
6
G
16
18
17
7
21
8
19
32
22
20
52
5
10
24
51
50
31

SAFETY SYSTEM FOR A STEAM TURBINE INSTALLATION

This invention concerns a safety system for a steam turbine installation such that at least one stop valve is provided upstream of the turbine, and at least one vacuum break valve downstream of the turbine, both being controlled by way of a regulating and safety device, the former in response to a speed governor signal, for example, and the latter in response to a speed monitor signal, for example.

Safety systems of this kind are known. The vacuum break valves, which as a rule are located at the condenser of condensing steam turbines, are normally opened on shutting down a turboset in order to reduce the vacuum partially, or break it completely. The increased windage then occurring in the low-pressure blading severely retards the decelerating shaft, and critical speeds are passed through more quickly. The vacuum break valves are so linked to the safety system of the turbine that they do not open until the safety system trips owing, for example, to overspeeding of the speed monitors. The system also closes the main stop valves of the turbine, and at the same time often gives the command to close to any controlled non-return extraction valves which may be present.

A disadvantage is the fact that this breaking of vacuum takes place every time the safety system trips, and thus occurs very frequently during the life of the turbine. To avoid risks regarding blade damage the vacuum break valves are normally closed again after vacuum has been reduced only moderately. Since this partial breaking of vacuum is of too little effect, it cannot really be considered as affording additional safety. Furthermore, owing to the manner of linkage with the usual safety system, breaking of vacuum does not become effective until the turbine has already reached a high speed.

With large installations, another known method is to provide an additional third valve ahead of the usual two control elements — main stop valve and governor valve — arranged in series in the flow direction. This extra valve is closed by an independent logic system at unacceptably high speeds. This measure, however, has the drawback that it results in high costs and causes a permanent additional pressure loss.

The object of the present invention is to supplement the safety facility normally present in a steam turbine installation by additonal means of safety which become effective only if the usual system fails.

In accordance with the invention this is achieved by a combination of the following features:

a. a means of monitoring flow downstream of the stop valve supplies a signal to a logic system, the valve of the signal normally corresponding to the setting of the stop valve;

b. in the event of a disparity, the logic system trips the safety system, whereupon the step valve closes and the vacuum, break valve partly opens;

c. if the means of monitoring flow detects a further mass flow after the prescribed partial vacuum has been reached, the vacuum break valve is fully opened by way of the logic system and means of protecting the blading are activated, whereas otherwise the vacuum break valve is closed again on attaining the prescribed partial vacuum.

The advantage of the invention lies especially in the fact that the additional safety thus achieved is obtained at relatively moderate cost, and also that it can be incorporated subsequently in installations already completed.

The device is especially simple if the means of monitoring flow is a differential-pressure sensor which can be connected between one or more turbine stages.

It is also of benefit if the comparing logic system contains two timing elements, one delaying tripping of the safety device by preferably 0.1 to 0.5 sec, and the other delaying breaking of full vacuum by preferably 1 to 5 sec.

A simple means of protecting the blading is envisaged whereby, on breaking full vacuum, condensate is fed via at least one water injection valve to the part of the blading at risk.

An example of the invention is shown schematically in the accompanying drawing as applied to a turbine installation having high and low-pressure turbines.

With reference now to the drawing the steam power installation shown incorporates a large multiple-casing turbine; plant components not essential to the invention, such as feedwater pump, feedheater train and the like, are omitted. The flow direction of the working medium (steam, condensate) and the directions of the transmitted electrical signals, which for clarity are shown as broken lines, are indicated by arrows.

The live steam line 1 brings the highly compressed steam from a steam generator 51 to the main stop valve 2 and the governor valve 3. The construction and arrangement of these valves, and also their number and sequence, are immaterial to the invention: for simplicity, only one stop valve and one governor valve are shown in the chosen example.

The steam then expands in the high-pressure turbine 4 and flows into a heat exchanger 5. This heat exchanger 5 can be incorporated in the steam generator in known manner as a reheater. In the case of a saturated-steam nuclear power plant, however, it can also be a water separator alone, or a water separator and a steam-heated reheater. Essential to the chosen example is only the fact that its storage volume is of such a size that, in order to avoid overspeeding, at least one valve, for example an interceptor valve 7 and possibly also a second valve as a main low-pressure valve 8, is incorporated in the steam line prior to entry into the low-pressure turbine 6. The construction of these valves and also their number and arrangement are also immaterial to the invention.

The now expanded steam flows through the exhaust steam pipe to the condenser 10. Pump 24 conveys the condensate through the feedheater train (not shown) to the feedpump and back to the steam generator 51. Block 11 contains a regulating and safety device which is not described in more detail. It generates the signals for actuating the regulating and safety control elements. The signal 12 controls the main stop valve 2 via the servo system 13. Signal 14 controls the setting of the governor valve 3 via the servo system 15. Signal 16 controls the setting of the interceptor valve 7 via the servo system 17, and signal 18 the setting of the main low-pressure valve 8 via servo system 19.

The installation is also equipped with one or more vacuum break valves 20. The vacuum break valves, too, are controlled by the system 11 via a signal 21 and servo signal 22.

The specific design of system 11 and also the nature of the signals 12/14/16/18/21 and their respective servo systems 13/15/17/19/22 are immaterial to the invention: the signals can be hydraulic or pneumatic pressure signals, or electrical signals in the form of voltages or currents. It is only essential that the servo systems 13, 15, 17, 19, and 22 produce a linear or angular setting of the control elements, 2, 3, 7, 8, 20 which is unambiguously related to the value of the control signals 12, 14, 16, 18, and 21.

In accordance with the invention, the steam turbine with safety and control system described above, and taken as known, is supplemented by the following components: a sensor 25 is connected to the inlet and outlet sides of the high-pressure turbine 4. This monitors the pressure difference across the high-pressure blading and passes a signal 26 to the logic system contained in block 27. The correcting signal 14 for the high-pressure governor valve 3 and the correcting signal 12 for the high-pressure stop valve 2 are also fed to logic system 27. The logic system 27 emits two signals: a first signal 28 is connected to system 11 and produces a tripping command for the safety system. A second signal 29 to the OR element 30, the output signal 31 of which is fed via a maximum-value discriminator 32 to the servo system 22 of vacuum break valve 20. It is also part of the invention that the control signal 21 is fed via this discriminator 32. Furthermore, signal 31 is fed to the boiler control system at arrow 50 as a shutdown signal for the boiler furnace. Also, the signal 31, acting via servo system 33, controls a water injection valve 34 which allows cooling water for cooling the last rows of the low-pressure blading to flow to injection nozzles (not further described) located in a suitable place for this purpose. This cooling water is preferably condensate drawn off after the condensate pump 24 and before the feedheater train (not shown).

A second detector 35 measures the pressure difference across the blading of the low-pressure turbine, and passes its signal 36 to the logic system 37. Also fed to logic 37 are the signal 16 for the interceptor valve 7 and the signal 18 for the low-pressure valve 8. A first output signal 38 is fed to the control device 11, and a second output signal 39 to the OR element 30.

The system functions in the following manner: it is assumed that owing to a simultaneous defect as values 2 and 3 — salt deposits in the valve spindle guides, for example — both valves 2 and 3 remain at least partly open when load is dumped (e.g., by opening the generator circuit-breaker).

When load disconnection occurs, the turbine speed will at first rise owing to strong acceleration. The turbine governing system contained in device 11 will very quickly modulate the correcting signals 14 and 16 in the "close" direction, and under normal circumstances the valves 3 and 7 are completely closed a few tenths of a second after load rejection commences. It is assumed, however, that the governor valve 3, for example, does not close, or not completely, i.e., it does not obey the control command 14. Logic system 27 will then establish that the correcting signal 14 is indeed at "zero flow", but that there is still a positive pressure difference across the high-pressure blading. The critical pressure difference is preferably equivalent to some 5–10% of the normal pressure difference at full load. After a few tenths of a second, preferably after 0.2 - 0.5 sec, the logic system will pass signal 28 to the safety device 11, whereupon tripping of the safety system is initiated before the speed reaches the usual set value of the speed monitors. The following commands accompany tripping: closure of stop valves 2 and 8, partial opening of vacuum break valve 20, etc. To protect the low-pressure blading against excessive stress due to the heat retained when braking commences and against vibration caused at the same time, the vacuum break valve is as a rule closed again after vacuum has decreased only moderately (with large turbines it is usual to allow the pressure in the condenser to rise to values of between about 0.2 and 0.3 bar). The second stage of the logic system checks whether the pressure difference across the blading disappears within a sufficiently short time after the safety system trips. Since the vacuum break valve 20 has already opened, it now only remains to decide whether it should close again on reaching the set partial vacuum, or whether within the terms of the invention it should close at a higher condenser pressure. For this decision a longer time can be chosen: it takes in any case longer than 5 sec until the partial vacuum mentioned is reached, whereupon the vacuum break valve 20 would close again. Consequently, the second timing stage can be made adjustable between 1 and 5 sec. If after this time the pressure difference across the blading is still above the set valve stated above, signal 29 is activated and this initiates simultaneously the following reactions via the OR element 30: The vacuum break valve 22 is opened via the minimum-valve discriminator 32. The steam generator 51 receives a signal 31 (50) for the command "shut down burners" or "reactor scram." If with a boiling water reactor, there are additional stop valves 52 at the outlet, these valves must also be closed by signal 31. Also, servo system 33 opens the water injection valve 34, thus reducing the danger to the blading.

The circumstances considered hitherto relate, for example, to full load rejection which the governor system can handle alone, without the safety system (fast shutdown) responding. Large modern installations are equipped with a range of monitoring and warning devices which can trip both alarms and the safety system. If the latter is tripped in such a case — for instance if excessively high bearing temperature is detected — then the output values of both pairs of signals 12/14 and 16/18 change simultaneously to positional command "closed." If — as can be expected with the fault assumed here — the signal "pressure difference" 26 does not reach to zero within the necessary short time, the logic system 27 will directly activate the signal 29 for breaking volume.

The application of the additional safety facility described is of course not restricted to turbines of two sections having between them heat exchangers 5 which constitute a storage volume. However, the effectiveness of this facility is particularly marked with turbines of this construction, as calculations have shown. The chance that all four control elements 2, 3, 7, and 8 will stick open simultaneously in orders of magnitude less probable than that only the high-pressure valves or only the low-presure valve will stick, perhaps only partly, at the same time, and this has the advantage that the steam still in the machine does work either only with the partial drop of the high-pressure blading (and then as a rule escapes to atmosphere through safety valves, not shown, on the heat exchanger 5) or with the partial drop of the low-pressure blading, and hence causes only moderate acceleration of the rotor. It is evident from the results of calculation, and obvious to the specialist, that particular importance attaches to the gradient of pressure rise in the condenser, and that under certain circumstances it will be expedient to make the vacuum break valve larger than has been customary in the past.

Overspeed calculation on full load rejection for an existing large turbine with, in each case, four valves opening in parallel shows that even with a governor valve and stop valve stuck fully open, the overspeed of 120% is only just exceeded for no more than a short time, and this with the existing vacuum break valves.

The invention is of course not limited to what is shown in the drawing. Further interesting consequences can arise if it is applied to turbines for nuclear power plants. Three cases can be distinguished: with these turbines, governor and stop valves are mounted in series before the low-pressure inlet in numbers of none, one or two, depending on the energy stored in the heat exchanger 5.

Case 1: No control element is needed if the energy storage between the turbine sections is so small that the set on load rejection can be held below the fast shutdown speed by using the high-pressure governor valves alone.

Case 2: One control element is sufficient when, if this control element fails, the fast shutdown speed (normally 100–112% of nominal speed) is exceeded but it is certain that the higher overspeed limit (120–125%) will not be reached, there being various additional means which can be used to achieve this aim.

Case 3: Two control elements (7 and 8) in each inlet pipe are necessary if on failure of control element 7 it is highly likely that on load rejection the overspeed limit would be exceeded.

The use of the system of the invention is one of the possible ways by which, for all the nuclear power stations built or planned at present, it could be certain to avoid the third case mentioned. This means that instead of two valves in series, only one would then be sufficient, with the benefits of a substantial reduction in cost and lower pressure losses.

In connection with the reasons mentioned, it may be expedient to install a part of all of the additional safety system in multiple-channel form, using known principles, e.g., two-out-of-three. These are techniques familiar to the specialist, and their application would not signify any extension of the invention.

I claim:

1. In a safety system for a steam turbine installation which comprises a steam generator, at least one stop valve located in the steam flow path from the steam generator upstream of the turbine and at least one vacuum break valve located in the steam flow path downstream of the turbine, and a combined regulating and safety device connected to the turbine and which produces signals for controlling said stop and vacuum break valves, the improvement characterized by a combination of the following features:

a. means for monitoring steam flow downstream of said stop valve and which supplies a corresponding signal to a logic system, the value of said signal normally corresponding to the setting of said stop valve, b. said logic system in the event of a disparity serving to trip said regulating and safety device thereupon to effect a closure of said stop valve and a partial opening of said vacuum break valve, and c. upon detection of a further mass flow by said steam flow monitoring means after the prescribed partial vaccum has been reached, said logic system serves to move said vacuum break valve to its full open position and active means provided for protecting the turbine blading, whereas otherwise said vacuum break valve is closed again on attaining the prescribed partial vacuum.

2. A safety system for a steam turbine installation as defined in claim 1 wherein said means for monitoring steam flow downstream of said stop valve is constituted by a pressure sensor connected to and which measures the pressure difference across at least one stage of the turbine.

3. A safey system for a steam turbine installation as defined in claim 1 wherein said logic system which compares the mass flow with a corresponding signal for said stop valve from said regulating and safety device includes a first timing element that delays emission of the signal for tripping said regulating and safety device by an adjustable time of between 0.2 and 0.5 second and further includes a second timing elemet that delays emission of the signal for actuating said vacuum break valve by an adjustable time of between 1 and 5 seconds.

4. A safety system for a steam turbine installation as defined in claim 1 wherein said means for protecting the turbine blading comprises at least one water injection valve which admits cooling water to that part of the turbine blading requiring protection, said injection valve being controlled by a servo system responsive to the same signal that actuates said vacuum break valve.

5. A safety system for a steam turbine installation as defined in claim 1 and which further includes means for shutting down said steam generator in the event said vacuum break valve is moved to its fully open position and an emergency stop valve located in the steam outlet side of said steam generator is closed by a signal from said logic system.

* * * * *